United States Patent [19]

Yamashita et al.

[11] 4,191,716

[45] Mar. 4, 1980

[54] CARBURETOR FOR INTERNAL COMBUSTION ENGINES

[75] Inventors: Ryuichi Yamashita; Hiromitsu Matsumoto, both of Hamamatsu, Japan

[73] Assignee: Yamaha Hatsudoki Kabushiki Kaisha, Iwata, Japan

[21] Appl. No.: 970,135

[22] Filed: Dec. 18, 1978

Related U.S. Application Data

[63] Continuation of Ser. No. 851,264, Nov. 14, 1977, abandoned, which is a continuation of Ser. No. 649,214, Jan. 15, 1976, abandoned.

[30] Foreign Application Priority Data

Feb. 26, 1975 [JP] Japan ..... 50-23586

[51] Int. Cl.[2] ..... F02M 1/06

[52] U.S. Cl. ..... 261/23 A; 261/39 D; 261/72 R; 261/DIG. 67; 123/179 G; 123/180 T

[58] Field of Search ..... 261/23 A, 39 D, DIG. 67, 261/72 R; 123/179 G, 180 T

[56] References Cited

U.S. PATENT DOCUMENTS

| | | | |
|---|---|---|---|
| 1,740,843 | 12/1929 | Stickney | 123/180 R |
| 1,883,809 | 10/1932 | Mennesson | 261/39 D |
| 1,904,936 | 4/1933 | Stokes | 261/39 D |
| 2,389,922 | 11/1945 | Mennesson | 261/34 A |
| 2,557,111 | 6/1951 | Jorgensen et al. | 261/39 D |
| 2,786,659 | 3/1957 | Mennesson | 261/39 D |
| 3,246,886 | 4/1966 | Goodyear et al. | 261/39 D |
| 3,285,585 | 11/1966 | Mennesson | 261/50 A |
| 3,307,837 | 3/1967 | Winkler | 261/DIG. 67 |
| 3,348,824 | 10/1967 | Soubis | 261/48 |
| 3,789,812 | 2/1974 | Berry et al. | 261/DIG. 67 |
| 3,872,851 | 3/1975 | Matsumoto et al. | 261/39 D |
| 3,877,448 | 4/1975 | Schmid | 261/39 D |
| 3,885,545 | 5/1975 | Charron et al. | 261/DIG. 67 |
| 3,917,760 | 11/1975 | Swatman | 261/44 C |
| 3,934,571 | 1/1976 | Mennesson | 261/39 D |
| 3,967,610 | 7/1976 | Ross | 261/39 D |

FOREIGN PATENT DOCUMENTS

| | | | |
|---|---|---|---|
| 538751 | 6/1956 | Fed. Rep. of Germany | 261/39 D |
| 700188 | 12/1930 | France | 261/39 D |
| 780915 | 2/1935 | France | 261/39 D |
| 980684 | 12/1950 | France | 261/39 D |
| 1002727 | 3/1952 | France | 261/39 D |
| 2205110 | 5/1974 | France | 261/39 D |
| 479160 | 2/1938 | United Kingdom | 261/DIG. 67 |

*Primary Examiner*—Tim R. Miles

*Attorney, Agent, or Firm*—Donald D. Mon

[57] ABSTRACT

A carburetor for internal combustion engines including an intake passage leading to a combustion chamber of the engine, a main fuel nozzle opening to the intake passage, a main throttle valve device provided in said intake passage, a float chamber for supplying fuel to said main fuel nozzle, a starting air passage opening to the intake passage at the downstream side of the throttle valve shut-off valve in the starting air passage, a second float chamber for supplying fuel to said starting air passage, and a passage introducing intake suction pressure to the upper portion of only the second float chamber. Also disclosed is apparatus wherein the main fuel nozzle and starting fuel nozzle communicate with a common float chamber, and the starter valve means comprises means for connecting the overlaying region of said float chamber with the intake passage downstream of the throttle valve when the starter valve means is in the open position.

5 Claims, 6 Drawing Figures

18
11
9
10
12
22
8
13
15
16
14
19
23
20
17
21
25a
26
24
25
28
6
7
33
27
3
31
34
4
1
32
29
31
2
5

CARBURETOR FOR INTERNAL COMBUSTION ENGINES

CROSS-REFERENCE TO OTHER PATENT APPLICATIONS

This is a continuation of applicant's co-pending application, Ser. No. 851,264, filed Nov. 19, 1977, entitled "Carburetor for Internal Combustion Engines," now abandoned, and which in turn is a continuation of application Ser. No. 649,214, filed Jan. 15, 1976, entitled "Carburetor for Internal Combustion Engines," now abandoned.

The present invention relates to fuel supply means for internal combustion engines which can be supplied during normal operation with air-fuel mixture having air-fuel mixing ratio leaner than the theoretical (stoichiometric) value.

It has been known and already put into practice, in order to eliminate air pollution problem caused by exhaust gas of internal combustion engines, to supply internal combustion engines with an air-fuel mixture having mixing ratio leaner than the theoretical value so as to decrease the amount of unburnt constituents in the exhaust gas. In many engines, and especially in lean burning engines, difficulties are often encountered in starting the engines under low engine temperature because actual air-fuel mixture supplied to the engines under such conditions is excessively fuel lean. Therefore, in actual practice, particular means is provided in order to obtain a fuel rich mixture during low temperature engine start.

One of such means is so-called starting fuel supply means which includes starting air passage means of relatively small cross-sectional area for supplying air necessitated for engine start to engine intake passage means the downstream side of engine throttle valve means. Means is provided for supplying starting fuel to the starting air passage means so that air-fuel mixture of an appropriate mixing ratio is supplied through the starting air passage means to the engine intake passage means. Since the starting air passage means has cross-sectional area which is small in relation to that of the engine intake passage means, the starting air is allowed to flow therethrough with a relatively high speed whereby fuel is effectively drawn thereinto from fuel supply means such as a carburetor of known construction to form a relatively fuel rich mixture.

Starting fuel supply means of the known type is so constructed that air-fuel mixture of substantially constant mixing ratio is formed in the starting air passage. In this type of starting fuel supply means, when the engine throttle valve is opened after engine start so as to allow intake air to flow through the throttle valve into the intake passage, the amount of air-fuel mixture supplied through the starting air passage is decreased as the amount of intake air flow through the throttle valve increases, with the result that the total air-fuel mixture supplied to the engine becomes so lean that misfire may take place. Thus, especially with, internal combustion engines which are operated with air-fuel mixture having a mixing ratio leaner that the theoretical value, difficulties are encountered in starting the engines under low engine temperature, and also it has been very difficult to put the engines into loaded operation immediately after the engine start.

The present invention has an object to eliminate the aforementioned problems of the prior art.

Another object of the present invention is to provide means for enabling loaded operation of internal combustion engines even immediately after engine start under low engine temperature.

A further object of the present invention is to provide starting fuel supply means for internal combustion engines, in which the amount of supply of starting fuel can be increased in accordance with an increase in load on the engines.

The above and other objects of the present invention can be accomplished, in accordance with the present invention, by a carburetor for internal combustion engines, which includes operating mixture forming means which in the preferred embodiment of the invention forms an air-fuel mixture having a mixing ratio leaner than the theoretical value during normal operation of the engine, and starting fuel supply means for providing a supply of starting fuel during the engine starting and warming up period. The improvement comprises means in said starting fuel supply means for increasing the amount of supply of the starting fuel in response to an increase in load imposed on the engine. The concept of the present invention can be very simply embodied in a float type carburetor by introducing engine intake suction pressure into the float chamber of the starting fuel supply means, so that the supply of fuel to the engine combustion chamber can be increased in response to an increase in the engine intake pressure. The arrangement is also effective to prevent formation of excessively fuel rich mixture during rapid deceleration of the engine when the starting fuel supply means is in operation, because a rapid decrease in engine intake pressure which will be produced during rapid deceleration of engine is effectively utilized to have an influence on the float chamber so that the supply of starting fuel is decreased to attain substantially constant air-fuel mixing ratio. It should be noted, however, that the present invention can also be embodied in engine fuel supply means other than a float type carburetor.

According to the present invention, the supply of starting fuel can be increased either by increasing the amount of supply of starting air-fuel mixture having a substantially constant mixing ratio, or by increasing the amount of starting fuel so that a fuel rich mixture is supplied from the starting fuel supply means.

The above and other objects and features of the present invention will become apparent from the following descriptions of preferred embodiments taking reference to the accompanying drawings, in which:

FIG. 3(*b*) is a view taken substantially along the line B—B in FIG. 3(*a*) and seen in the direction of arrows.

Figure 1:
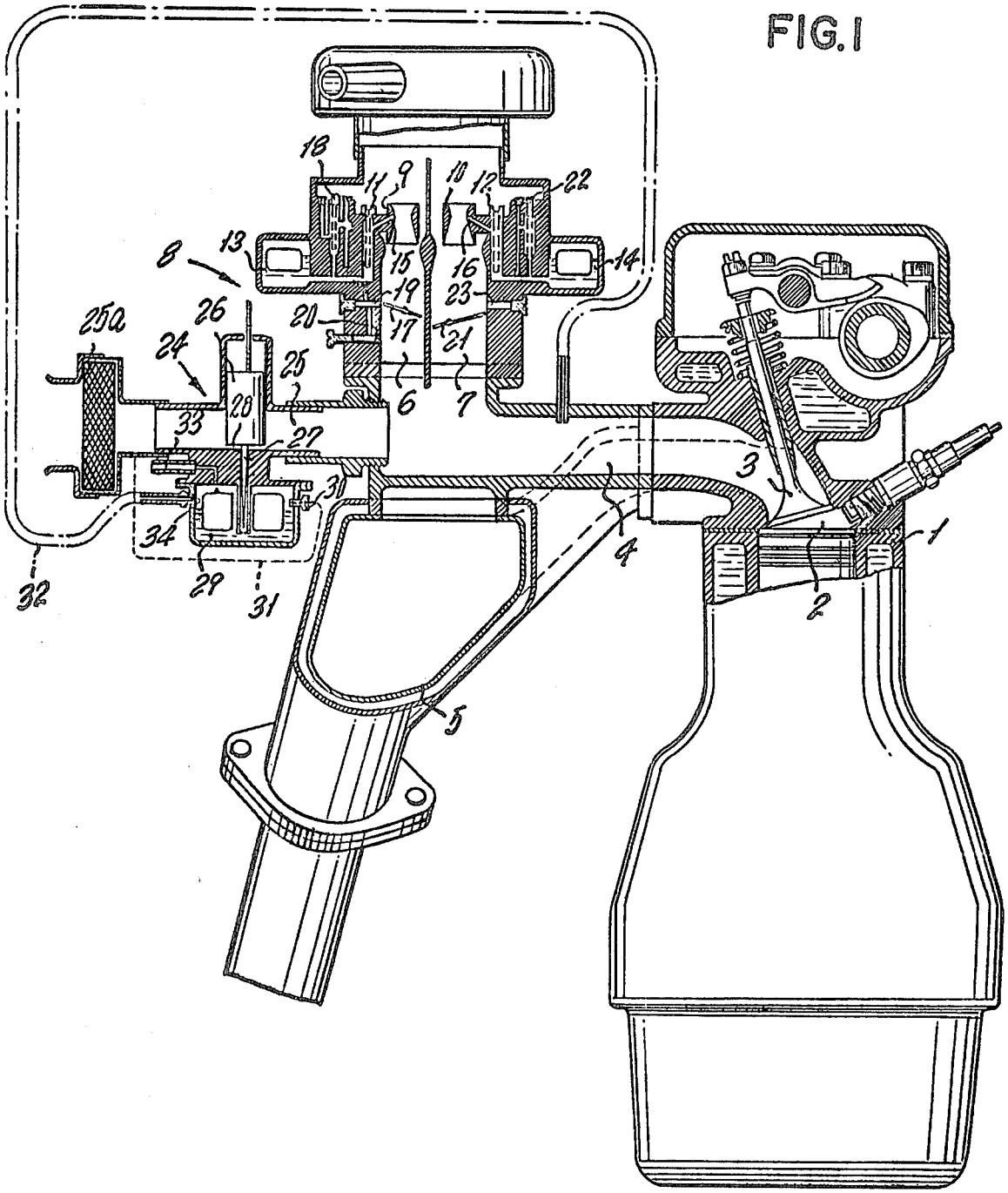
FIG. 1 is a sectional view showing a fuel supply system embodying the features of the present invention.

Referring now to the drawings, particularly to FIG. 1, there is shown an internal combustion engine including a cylinder 1 which has a combustion chamber 2 defined therein. The combustion chamber 2 is connected through an intake valve 3 with an intake passage 4 and also through an exhaust valve (not shown) with an exhaust pipe 5. The intake passage 4 is connected with a carburetor 8 having primary and secondary passages 6 and 7. The passages 6 and 7 are respectively provided with venturi devices 9 and 10 which respectively have main fuel nozzles 15 and 16 opening therein. The venturi devices 9 and 10 are respectively connected through air bleed devices 11 and 12 with float chambers 13 and 14.

The primary passage 6 is provided with a throttle valve 17 and two slow ports 19 and 20 which are opened at the side wall of the primary passage 6. The slow ports 19 and 20 are connected through an air bleed device 18 with the float chamber 13. Similarly, the secondary passage 7 is provided with a throttle valve 21 and a bypass port 23 which opens to the passage 7 at the side wall thereof. The bypass port 23 is connected through an air bleed device 22 with the float chamber 14. The throttle valve 21 is so arranged that it is normally in the closed position and started to open after the throttle valve 17 is fully opened or substantially fully opened during high load operation of the engine so as to allow intake air to pass through both of the passages 6 and 7. In the preferred embodiment carburetor 8 is so designed that air-fuel mixture supplied through the passages 6 and 7 during normal operation of the engine has air-fuel ratio leaner than theoretical value, preferably greater than 17.

The carburetor 8 includes starting fuel supply means 24 which is provided with a passage 25 communicating at one end with the intake passage 4. At the other end of the passage 25, there is provided an air cleaner 25*a*. The passage 25 is provided with a manually operated starter valve 26 which has a needle 27 inserted into a starting fuel nozzle 28 opening to the passage 25 at the side wall thereof. The nozzle 28 is in communication at the bottom portion of a float chamber 29. The upper portion of the float chamber 29 (i.e., the "region overlaying fuel" in the float chamber) is connected on one hand through a restriction orifice 30 and a conduit 31 with the passage 25 at the upstream side of the valve 26 and, on the other hand, through a resitriction orifice 34 and a conduit 32 ("connecting passage means") with the intake passage 4. Thus, the float chamber 29 is subjected to a pressure substantially proportional to the intake pressure in the intake passage 4. A fuel supply line 33 is connected with the float chamber 29 to supply fuel thereto under a control of a float valve as well known in the art.

In operation, the engine is started with the valve 26 in open position. Air is introduced through the passage 25 into the intake passage 4 and fuel is drawn from the float chamber 29 through the nozzle 28 into the passage 25. Thus, air-fuel mixture is formed in the passage 25 and supplied therefrom into the intake passage 4. The starting fuel supply means of this type is known as being advantageous in that, since the cross-sectional area of the passage 25 is small in relation to that of the passage 6, adequate air flow speed is maintained in the passage 25 to draw sufficient amount of fuel through the nozzle 28 even though the total amount of air flow is very small during starting period of the engine. In the illustrated arrangement, further advantages can be obtained due to the fact that the pressure in the float chamber 29 is influenced by that in the intake passage 4. When the throttle valve 17 is opened after engine start for loaded operation of the engine, air is allowed to flow through the passage 6 into the intake passage 4. However, since the flow speed of the air through the passage 6 is not sufficiently high to draw fuel from the slow ports 19 and 20, the additional air supplied through the passage 6 into the intake passage 4 has an effect of diluting the mixture supplied through the passage 25. According to the illustrated arrangement, however, an increase in pressure in the engine intake passage 4 due to the increase in air flow through the passage 6 causes an increase in the pressure in the float chamber 29 so that the amount of fuel drawn through the nozzle 28 is also increased. Thus, the supply of starting fuel from the starting fuel supply means 24 is increased in response to an increase in the air flow through the primary passage 6 so that a substantially constant air-fuel mixing ratio can be maintained.

The arrangement is also advantageous in that, when the throttle valve 17 is rapidly closed for deceleration during loaded operation with the valve 26 still open, a rapid decrease in the intake pressure is transmitted into the float chamber 29 so as to correspondingly decrease the amount of the supply of starting fuel whereby a substantially constant air-fuel ratio is maintained.

Figure 2:
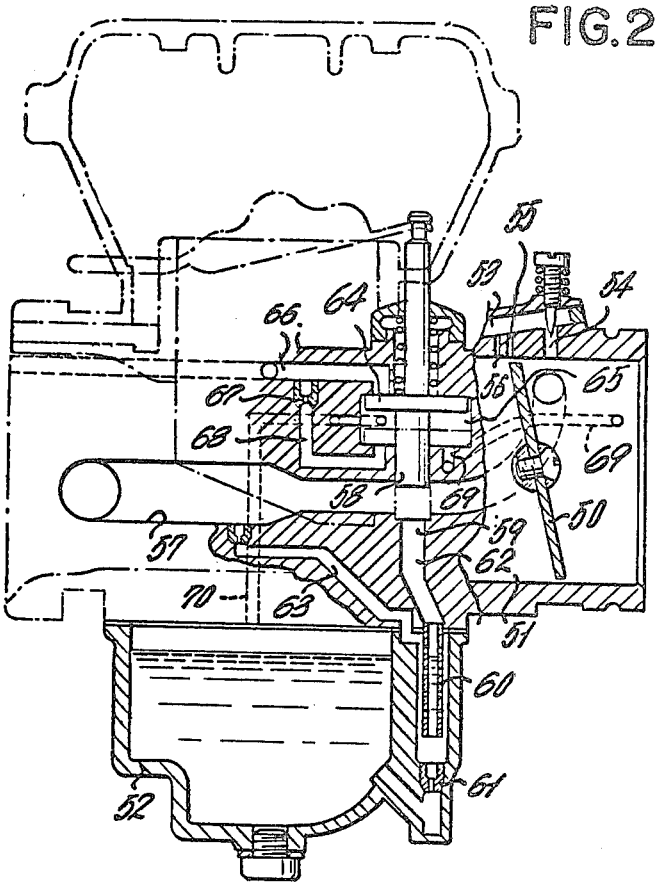
FIG. 2 is a fragmentary sectional view showing starting fuel supply means in accordance with another embodiment of the present invention.

FIG. 2 shows another embodiment of the present invention. In this embodiment, there is provided an intake passage 51 which has a throttle valve 50 disposed therein. The intake passage 51 is provided with an idle jet 54 and slow jets 55 and 56 which are connected through a passage 53 with a float chamber 52 so that fuel is supplied thereto from the float chamber 52. There is also provided a starting air passage 57 which is connected at one end with the intake passage 51 at the upstream side of the throttle valve 50 and at the other end also with the intake passage 51 at the downstream side of the throttle valve 50. The starting air passage 57 is provided with a manually operated starter valve 58. The passage 57 has a starting fuel nozzle 59 opening thereto in the vicinity of the starter valve 58. The nozzle 59 is connected through a passage 62 having an air bleed device 60 and a metering orifice 61 with the float chamber 52. The passage 57 is connected through a bleed air passage 63 with the passage 62.

The starter valve 58 is integrally formed with a valve disc 64 which is disposed in an air chamber 65. The air chamber is connected on one hand through an air passage 66 with the intake passage 51 at the upstream side of the throttle valve 50 and on the other hand through a restriction orifice 67 and a passage 68 with the passage 66 and through a passage 69 with the intake passage 51 at the downstream side of the throttle valve 50. The passage 66 is opened to the air chamber 65 at the upper wall thereof, the passages 68 and 69 at the lower wall thereof. Further, the air chamber 65 is connected with the upper portion of the float chamber 52 through a passage 70 opening to the chamber 65 at the side wall thereof. The valve disc 64 is so designed that it establishes connection between the passage 66 and the chamber 65 through the orifice 67 and the passage 68, and opens the passages 69 and 70 to the chamber 65, when the starter valve 58 is in the open position. When the starter valve 58 is in the closed position, the passage 66 is directly connected with with the chamber 65 and the passage 70 is also opened to the chamber 65 but the passages 68 and 69 are interrupted from communication with the chamber 65 by the valve disc 64.

Thus, when the starter valve 58 is opened for engine start, starting air is allowed to pass through the passage 57 to the intake passage 51 with an adequate speed to draw fuel from the float chamber 52 through the metering orifice 61, the air bleed device 60, the passage 62 and the nozzle 59 into the passage 57. In this instance, the pressure in the chamber 65 is under the influence of the pressure in the intake passage 51 at the downstream side of the throttle valve 50, and the presence in the chamber 51 is transmitted to the float chamber 52. Therefore, as in the previous embodiment, the amount of fuel supplied from the float chamber 52 through the air bleed device 60, the passage 62 and the nozzle 59 into the starting air passage 57 is increased as the opening of the throttle valve 50 increases. When the starter valve 58 is closed, the chamber 65 is subjected to the atmospheric pressure which is transmitted thereto through the passage 66, and the atmospheric pressure is transmitted from the chamber 65 to the float chamber 52.

Figure 3A:
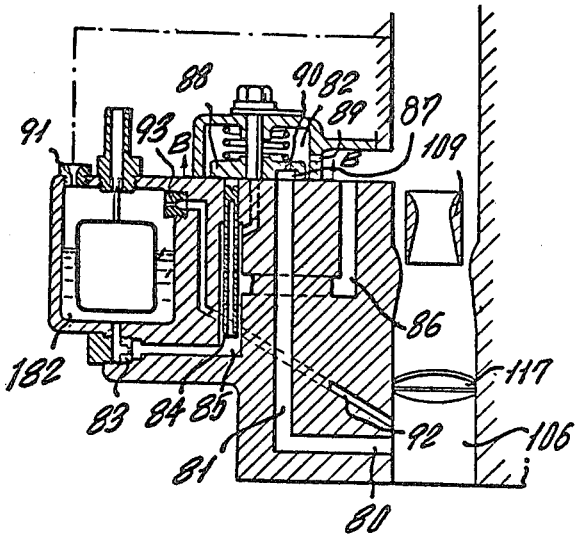
FIG. 3(*a*) is a fragmentary sectional view showing a further embodiment of the present invention.
Figure 3B:
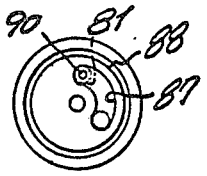

FIGS. 3(*a*) and (*b*) show starting fuel supply means in accordance with a further embodiment of the present invention. The starting fuel supply means may be used in combination with a carburetor substantially identical to that shown in FIG. 1. In FIG. 3(*a*), there is shown a primary intake passage 106 having a throttle valve 117 and a venturi device 109. The passage 106 has a starting fuel nozzle 80 opening thereto at the downstream side of the throttle valve 117. The nozzle 80 is connected through a passage 81 with a chamber 82.

The float chamber 182 is in communication through a passage 85 having a metering orifice 83 and an air bleed device 84 with a valve chamber 82. A bleed air passage 86 is provided, and connected at one end with the intake passage 106 at the upstream side of the throttle valve 117, and at the other end with the starting fuel passage 85. In the valve chamber 82, there is disposed a rotary valve plate 88 which has an arcuate groove 87 for connecting the passages 81 and 85 together in the open position thereof. The valve chamber 82 is also connected through an aperture 89 with the passage 106 at the upstream side of the throttle valve 117. The valve plate 88 is further provided with an aperture 90 for connecting the valve chamber 82 and the groove 87.

The float chamber 182 has a restriction orifice 91 which is connected with the intake passage 106 at the upstream side of the throttle valve 117. The float chamber 182 is also connected through a passage 92 having restriction orifice 93 with the intake passage 106 at the downstream side thereof.

When the engine is started with the valve plate 88 in the open position, the fuel in the float chamber 182 is drawn through the metering orifice 83 and the passage 85 having the air bleed device 84, and mixed with the bleed air introduced through the passage 86. In the valve plate 88, an additional air is supplied through the aperture 89, the valve chamber 82 and the aperture 90 into the groove 87 where the air is mixed with the air-bleeded fuel from the passage 85. Then, the fuel is directed with the bleed air through the passage 81 and the nozzle 80 into the intake passage 106.

It should be noted that in this embodiment the float chamber 182 is subjected to the influence of the pressure in the intake passage 106 at the downstream side of the throttle valve 117. Therefore, the arrangement is effective to increase the amount of supply starting fuel in response to an increase in the intake pressure which will be experienced when the throttle valve 117 is opened for loaded operation. Further, the arrangement is also effective to decrease the supply of starting fuel when the throttle valve is rapidly closed for deceleration during loaded operation of the engine with the valve plate 82 still in the open position, so as to prevent formation of excessively fuel rich mixture which may otherwise be produce due to a decrease in the intake air flow.

Figure 4:
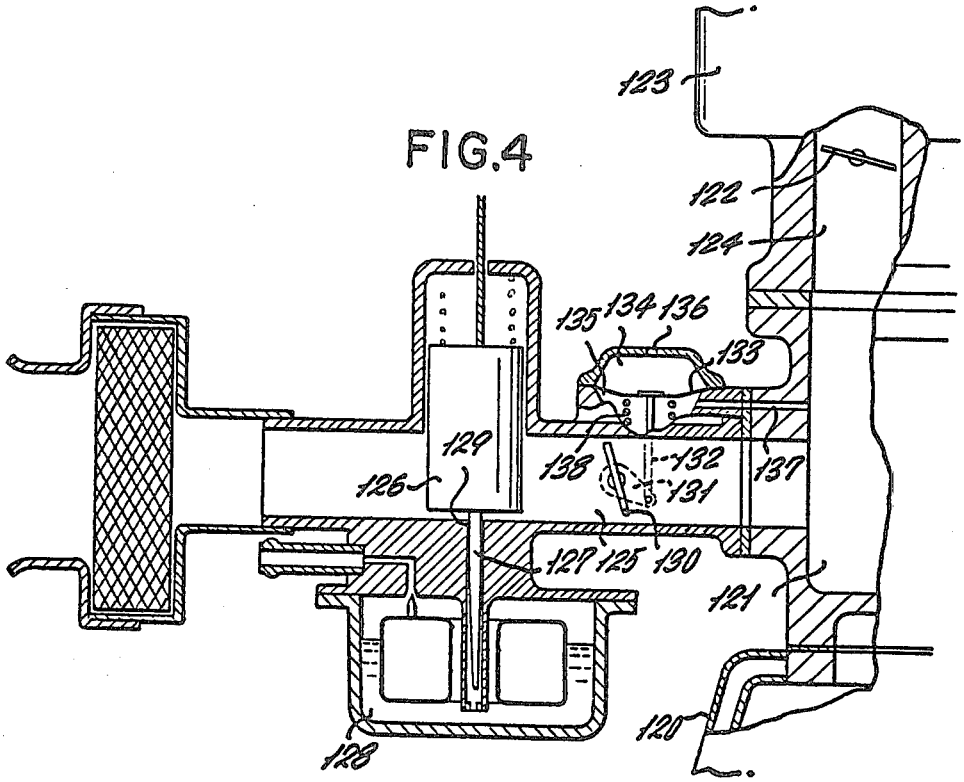

FIG. 4 shows a further embodiment of the present invention in which the amount of starting air-fuel mixture is controlled in accordance with a change in the opening of the engine throttle valve. In FIG. 4, there is shown an internal combustion engine 120 which includes a main intake passage 121 communicating with a main passage 124 having a throttle valve 122 disposed therein. The engine also includes a starting air-fuel mixture supply passage 125 which opens to the intake passage 121. The supply passage 125 has a manually operated starter valve 126 which is provided with a needle 127 adapted to be inserted into a nozzle 129 leading to a float chamber 128. Further, in the passage 125, there is also provided an auxiliary throttle valve 130 which is secured to an operating lever 131 connected through a push-rod 132 with a diaphragm 133. An atmospheric pressure chamber 134 and a suction pressure chamber 135 are defined at the opposite sides of the diaphragm 133. The chamber 134 is opened to the outside of the engine through an aperture 136 and the chamber 135 is connected through a passage 137 with the intake passage 121. In the suction pressure chamber 135, there is disposed a spring 138 for biasing the diaphragm 133 upwardly to open the throttle valve 130.

In the illustrated embodiment, when the engine is started with the starter valve 126 in the open position, air is allowed to flow through the passage 125 into the intake passage 121 with an adequate speed to draw fuel from the nozzle 129 into the passage 125. Thus, air-fuel mixture is formed in the passage 125 and supplied therefrom into the intake passage 121. The amount of the mixture supplied to the intake passage 121 is controlled by the opening of the throttle valve 130. When the main throttle valve 122 is opened after engine start, air is allowed to flow through the passage 124 into the intake passage 121 resulting in an increase in the pressure in the intake passage 121. The increase in the intake pressure in then transmitted into the suction pressure chamber 135 to cause upward displacement of the diaphragm 133 so as to increase the opening of the throttle valve 130. In this manner, the amount of supply of starting mixture can be increased in response to an increase in the main throttle valve 122.

Figure 5:
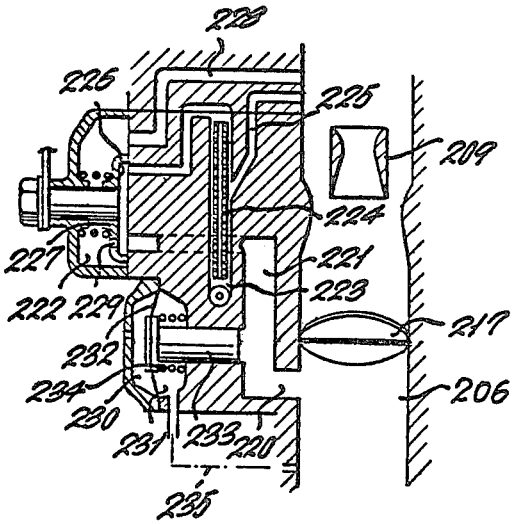
FIGS. 4 and 5 are sectional views showing further embodiments of the present invention.

FIG. 5 shows a further embodiment of the present invention, in which the carburetor is of substantially the same type as the embodiment shown in FIG. 1 and includes a primary intake pressure 206 provided with a throttle valve 217 and a venturi device 206. The intake passage 206 is provided with a starting fuel nozzle 220 which opens to the passage 206 at the downstream side of the throttle valve 217. The nozzle 220 is connected through a passage 221 with a valve chamber 222. Although not shown in the drawing, there is provided a starting float chamber which leads to a passage 223 having an air bleed device 224. The passage 223 is on one hand connected with the valve chamber 222 and, on the other hand through a bleed air passage 225 with the intake passage 206 at the upstream side of the throttle valve 217. In the valve chamber 222, there is disposed a rotary valve plate 227 which has an straight groove 226, for connecting the passages 221 and 223 together in the open position of the valve. The valve chamber 222 is connected through a passage 228 with the intake passage 206 at the upstream side of the throttle valve 217, and the valve plate 227 is formed with an aperture 227 for connecting the valve chamber 222 with the groove 226.

A valve member 233 is disposed in the passage 221 for controlling the opening of the passage. The valve member 233 is secured to a diaphragm 232 which defines an atmospheric pressure chamber 230 and a suction pressure chamber 231 at the opposite sides thereof. A spring 234 is disposed in the suction pressure chamber 231 for biasing the diaphragm 232 in such a direction that the opening of the passage 221 is increased. The suction pressure chamber 231 is connected through a passage 235 with the intake passage 206 at the downstream side of the throttle valve 217.

In this embodiment, when the engine is started with the valve plate 227 in the open position, air is allowed to flow through the passage 228, the valve chamber 222, the aperture 229, the groove 226, the passage 221 and the nozzle 220 into the intake passage 206. At the same time, bleed air is also drawn through the passage 225 into the passage 223 where the air is mixed with fuel from the float chamber, and the mixture is then directed into the groove 226 to be mixed with air from the passage 228 to form combustible starting mixture. The opening of the valve 223 is determined by the pressure in the intake passage 206 at the downstream side of the throttle valve 217 in such a manner that, when the opening of the throttle valve 217 increases, the opening of the valve 233 is also increased to increase the amount of supply of starting mixture.

The invention has thus been shown and described with reference to specific embodiments, however, it should be noted that the invention is in no way limited to the details of the illustrated embodiments but changes and modifications may be made without departing from the scope of the appended claims.

We claim:

1. A carburetor for an internal combustion engine which includes intake passage means leading to combustion chamber means of the engine, said carburetor comprising: throttle valve means provided in said intake passage means; a float chamber means having a region overlaying fuel therein; main fuel nozzle means provided in said intake passage means for supplying fuel from said main float chamber for normal operation of said engine; means for controlling supply of fuel to said main fuel nozzle means; starting air passage means which is smaller in cross-sectional area than the intake passage means and opening to the intake passage means at the downstream side of the throttle valve means; a starter valve means in said starting air passage means; means connected to said float chamber for supplying starting fuel to starting fuel nozzle means which starting fuel nozzle means opens to said starting air passage means for supplying starting fuel to said starting air passage means to form a starting air-fuel mixture, said starter valve means being provided with means for connecting said overlaying region of the float chamber means with said intake passage means at the downstream side of the throttle valve means when the starter valve means is in open position and opening said float chamber means to atmosphere when the starter valve means is in closed position, whereby the amount of starting fuel to said intake passage means is controlled in accordance with load on the engine in such a manner that the amount of starting fuel is increased as the engine load is increased.

2. A carburetor for an internal combustion engine which includes intake means leading to combustion chamber means of the engine, said carburetor comprising: throttle valve means provided in said intake passage means, a main float chamber having a region overlaying fuel therein; main fuel nozzle means provided in said intake passage means for supplying fuel from said main float chamber for normal operation of said intake passage means; means for controlling supply of fuel to said nozzle means; starting air passage means which is smaller in cross-sectional area than the intake passage means and opening to the intake passage means at the downstream side of the throttle valve means; a shut-off valve in said starting air passaage means; means for supplying starting fuel to said starting air passage means to form a starting air-fuel mixture, said last-named means including starter float chamber means connected to starting fuel nozzle means opening to said starting air passage means, said starter float chamber means having a region overlaying fuel therein; and starting fuel control means including connecting passage means for subjecting the said region of said starter float chamber means to the influence of intake pressure in the intake passage at the downstream side of the throttle valve means, whereby the amount of starting fuel to said intake passage means is controlled in accordance with load on the engine in such a manner that the amount of starting fuel is increased as the engine load is increased, said region in said main float chamber not being connected to said intake passage at the downstream side of the throttle valve means.

3. A carburetor in accordance with claim 2 in which said starting fuel control means includes means for controlling air-fuel ratio of the starting air-fuel mixture in response to a change in the engine load.

4. A carburetor in accordance with claim 2 in which said connecting passage means includes restriction orifice means, and in which said region overlaying fuel in said starter float chamber means is opened to atmosphere through second restriction orifice means.

5. A carburetor in accordance with claim 4 in which said opening of said overlaying region in said starter float chamber means through said second restriction orifice is to the starting air passage means, said starting air passage means being provided with air cleaning means at an end opposite to the intake passage means.

* * * * *